United States Patent [19]

Kuramochi

[11] 3,964,205

[45] June 22, 1976

[54] FIGURE WITH MOVABLE TRUNK, HEAD ETC., HAVING DRIVING DEVICE AND INDIVIDUAL OPERATION MEANS

[76] Inventor: Shigeaki Kuramochi, No. 24-17, Kolshikawa 5-chome, Bunkyo, Tokyo, Japan

[22] Filed: June 17, 1974

[21] Appl. No.: 480,278

[30] Foreign Application Priority Data

Aug. 23, 1973 Japan ..... 48-93892

[52] U.S. Cl. ..... 46/120; 46/126; 46/266

[51] Int. Cl.[2] ..... A63H 13/00

[58] Field of Search ..... 46/120, 121, 126, 139, 46/107, 104, 247

[56] References Cited

UNITED STATES PATENTS

| | | | |
|---|---|---|---|
| 1,927,861 | 9/1933 | Wypy | 46/107 |
| 2,327,234 | 8/1943 | Wolff et al. | 46/126 |
| 2,648,934 | 8/1953 | Syfert | 46/120 |
| 2,716,840 | 9/1955 | Armstrong | 46/126 X |
| 2,856,729 | 10/1958 | Clintsman | 46/126 X |
| 3,304,649 | 2/1967 | Fosser | 46/126 X |

*Primary Examiner*—F. Barry Shay

*Attorney, Agent, or Firm*—Stevens, Davis, Miller & Mosher

[57] ABSTRACT

A motion-toy is provided which is adapted to clap its hand, move its eyes inwardly and outwardly, move its ears, shake its head, move its lips, raise its voice and dance. The toy has a fixed frame and a frame having a trunk movable with respect to the fixed frame which is interlocked with other structure to move the various parts of the toy. The head, eyes and arms are rotatably mounted on the said movable frames. The movable frame is moved up and down by a driving device to operate the trunk, head, eyes and arms. An operating plate and lever arrangement is provided for operating the various parts of the toy selectively.

3 Claims, 9 Drawing Figures

FIGURE WITH MOVABLE TRUNK, HEAD ETC., HAVING DRIVING DEVICE AND INDIVIDUAL OPERATION MEANS

SUMMARY OF THE INVENTION

This invention is concerned with the motion-toy, especially the top-animals or dolls performing plural types of movements.

This invention is to offer the enjoyments of various movements by the toy-body demonstrating the movements of the toy-animal or doll with the vertical movement of a movable frame having a trunk against a fixed frame in association with the operation of a driving device. This vertical movement with the movable frame interlocked with various operation means renders the toy-animal or doll to move in various types. Namely, in the present invention, the toy-animal or doll claps hands in association with the reciprocal rotations of the arms at the both sides of the movable frame by a first operation means; puts in or out the eyes in association with the reciprocal rotation of an eye-frame having eyes and moves the ears in association with the reciprocal rotations of ear-frames having ears by a second operation means; shakes the head in association with the reciprocal rotation of a head-frame having a head, and at the same time, compresses and parts upper and under lips and raises voice in association with the operation of a resonator by a third operation means; and dances in association with the reciprocal rotation of the movable frame having a trunk by a fourth operation means; these movements being done with the selective operations, done at the same time or combinedly performed.

The other objects, advantages and novel features of the invention will become apparent from the detailed description with reference to a preferred embodiment of the invention. The description makes reference to the drawings.

DETAILED DESCRIPTION OF PREFERRED EMBODIMENTS

Figure 1:
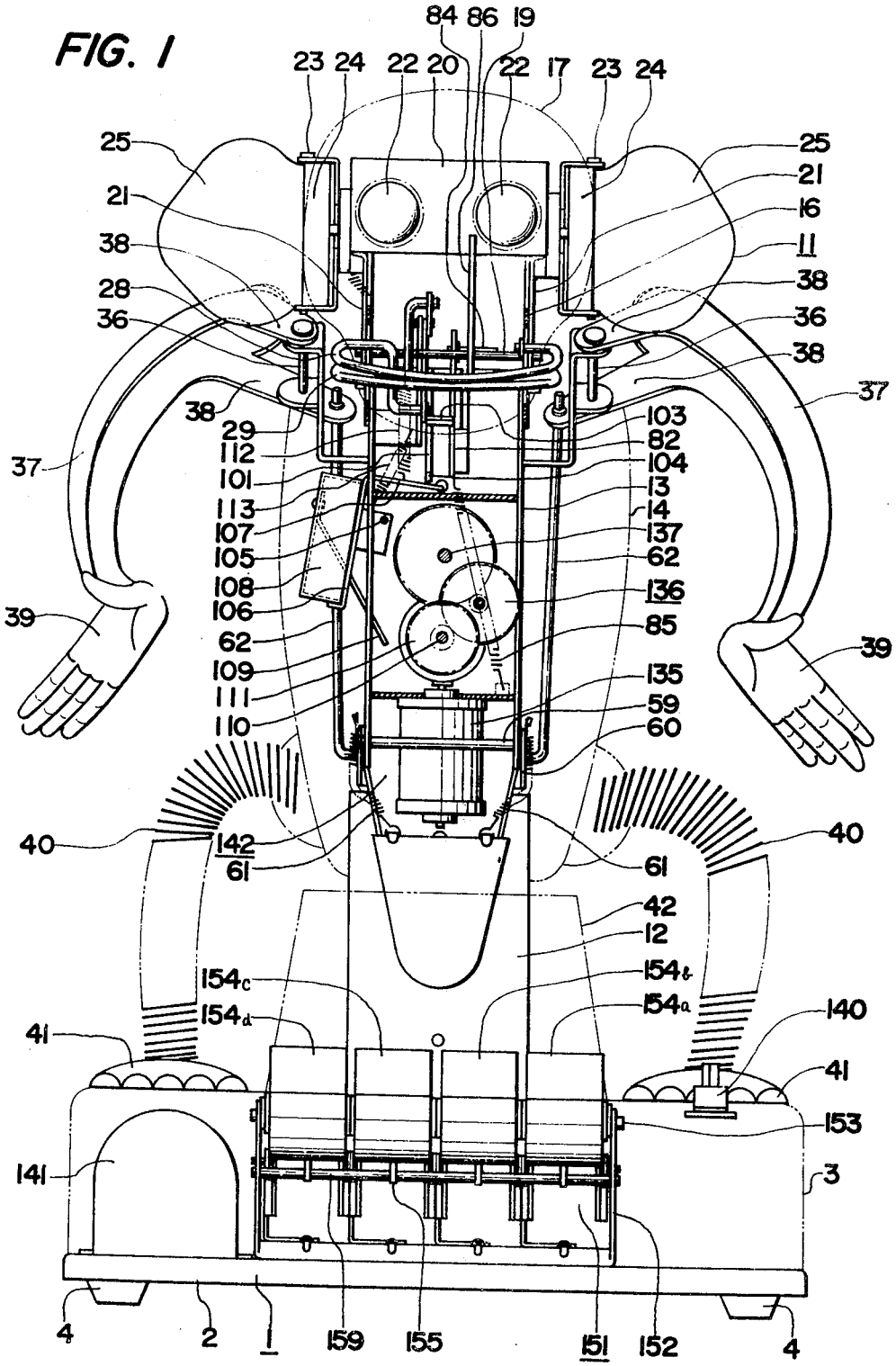
FIG. 1 is a sectional front view of te motion-toy of the present invention.
Figure 2:
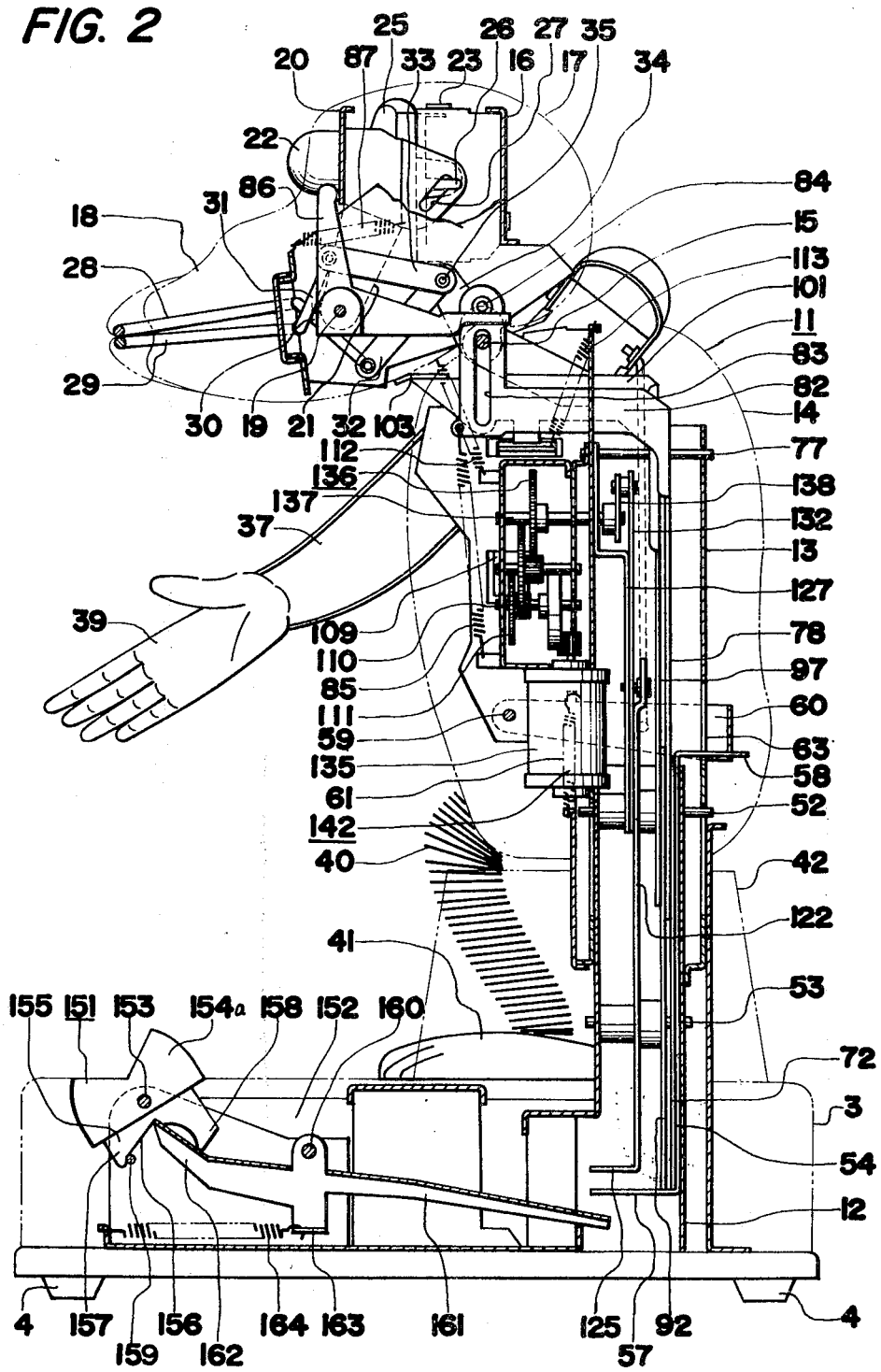
FIG. 2 shows a longitudinal sectional side view of the motion-toy.

In FIGS. 1 and 2, numeral 1 stands for a basic stand comprising a box-like cover 3 mounted on the upper part of a quadrilateral base 2, and supporting stands 4 installed to the four corners of the lower face of the base 2.

Upon the above mentioned basic stand 1, a toy-body 11 which composes a doll or toy-animal such as chimpanzee, etc. is installed. This toy-body 11 is composed of a sectionally quadrilateral fixed frame 12 installed to the hind part-center of the base 2 of the basic stand 1, a movable frame 13 installed movably freely to the upper part of said fixed frame 12, and a trunk 14 mounted on the outside of said movable frame 13.

The lower part of a head-frame 16 is installed rotatably freely forwards and backwards to a supporting shaft 15 at the upper end of the above mentioned movable frame 13, and a head 17 is installed to the outside of said head-frame 16.

To the front part of the above mentioned head-frame 16 an eye-frame 20 is installed rotatably freely forwards and backwards around a supporting shaft 19 through supporting pieces 21 forming in general at the lower part of both sides of the eye-frame 20. A pair of eyes 22 in a nearly hemispheric shape are installed to the front and both sides of the eye-frame 20.

Ear-frames 24 are mounted rotatably freely forwards and backwards on vertical supporting shafts 23 provided at both sides of the head-frame 16, and ears 25 are fixed at both of the ear-frames 24. Protruding pieces 26 are installed projectingly to the inside of the ear-frames 24 of both sides as a unit, and inserted into prolonged holes 27 extending in the forward and lower directions which are formed at both sides of said eye-frame 20.

A pair of upper and under lips 28, 29 in semi-circular shapes made of metal bars are installed rotatably freely in the vertical direction to the front end-lower part of said head-frame 16. From one side-inner end of these upper and under lips 28, 29, coupled parts 30, 31 are extendingly installed as a unit to the direction crosswisely in the form of X-type each other. To the inner end-part of each of these coupling parts 30, 31, one end-part of each of the links 32, 33 is interlocked respectively rotatably freely, and the other end-part of each of these links 32, 33 is interlocked rotatably freely through a shaft 35 to a fixed piece 34 fastened through the supporting shaft 15 to the head-frame 16, said upper and under lips 28, 29, coupling parts 30, 31 and links 32, 33 composing a movable quadrilateral frame.

On both sides of the upper part of the above mentioned movable frame 13, arms 37 are mounted rotatably freely backwards and forwards through supporting pieces 38 protruding as a unit from the upper and lower parts of the base portions of said arms 37 around supporting shafts 36 slanting towards the hind and lower directions, and hands 39 are mounted to the pointed ends of the arms 37 of said both sides.

The upper part of a freely expansive leg 40 composed of a coil-spring is coupled to each side-lower part of said trunk 14, and the lower part of the leg 40 of each side is coupled to a foot 41 fixed to the upper face of the cover 3 of said basic stand 1.

A nearly cylinder-like stand-body 42 installed to the upper face of the cover 3 of said basic stand 1 at the lower position of the body 14.

Thus, the toy-body 11 equipped with the trunk 14, head 17, eyes 22, ears 25, lips 28, 29, arms 37, hands 39, legs 40 and feet 41 is sat on the stand-body 42. Further, a fur-like ornament is made on the outside of the toy-body 11 for making it into toy-animals or dolls by dressing.

Thus, the above mentioned toy-body 11 starts its operation due to first to fourth operation means.

Figure 6:
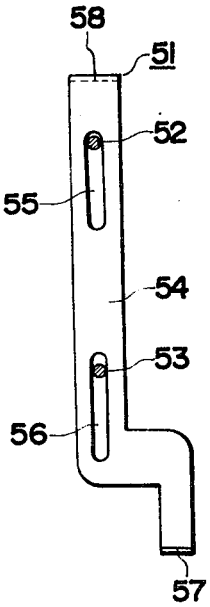

Firstly, explanation is made on the first operation means 51 which moves the arm of the toy-body 11. This first operation means 51 is demonstrated in FIGS. 1, 2 and 3 as well as FIG. 6. Supporting shafts 52, 53 are mounted on the longitudinal direction at the central upper or lower parts of said fixed frame 12, and an operating plate 54 is supported movably freely in the vertical direction by the upper and lower supporting shafts 52, 53 through vertically prolonged holes 55, 56 perforated at the upper and lower parts of the operating plate 54. A push-moving part 57 is formed by bending at the lower end-part of said operating plate 54, and at the same time, the upper end-part of an operating part 58 is bent so as to protrude backwardly from an aperture-part 63 which serves as an engaging portion in the hind face of the movable frame 13 and engaged with the lower end of said aperture-part 63. Moreover, the forward end-part of an operating framework 60 in the form of "⊐" is mounted rotatably freely forwards and backwards on a supporting shaft 59, and coil-springs 61 are stretched between both sides of said operating framework 60 and the movable frame 13 so that the operating framework 60 is always energized downwards and the hind side-part of the operating framework 60 is touched and connected to the operating part 58 of the upper end of said operating plate 54. Moreover, the lower end-part of an interlocking lever 62 is coupled rotatably freely to the intermediate part of each side of said operating frame 60, and the upper end-part of each side-interlocking lever 62 is coupled rotatably freely to the inner end-part of the lower supporting piece 38 of the base portion of the arm 37.

Next, explanation is made on the second operation means 71 which moves the eyes and ears of the toy-body 11. This second operation means 71 is shown in FIGS. 1, 2, 4 and 7. That is, an operating plate 72 is upheld movably freely in the vertical direction by the supporting shafts 52, 53 of said fixed frame 12 through vertically prolonged holes 73, 74 perforated at the upper and lower parts of the plate 72, and a push-moving part 75 is formed by bending forwards at the lower end-part of said plate 72, at the same time, a projection 76 is installed protrudently to the front of the upper end-part of said operating plate 72. At the front position of said operating plate 72, an upper operating plate 78 is upheld movably freely in the vertical direction by said supporting shaft 52 and a supporting shaft 77 mounted in the longitudinal direction on the upper part of the movable frame 13 through vertically prolonged holes 79, 80 perforated at the upper and lower parts of said plate 78. An arched laterally prolonged hole 81 is formed above the upper position of the supporting shaft 52 at the lower part of said upper operating plate 78 and the projection 76 of the working plate is engaged to said arched long hole 81. A nearly L-type operating part 82 is formed by bending forwards at the upper part of said operating plate 78. A vertically prolonged hole 83 is formed at this operating part 82, and this prolonged hole 83 is inlaid with the supporting shaft 15 of said head-frame 16. A pin 84 is protrudently installed at the upper end-part of the operating part 82, while a coil-spring 85 is stretched between the lower end-part of said operating part 82 and the movable frame 14 so that the upper operating plate 78 is energized downwards at any time. Said operating plate 72 and upper operating plate 78 compose an operating body movable as a unit in the vertical direction. Further, an operating piece 86 in the form of bell-crank is mounted rotatably freely to the supporting shaft 19 installed to the head-frame 16, and the pointed end of the horizontal side-part of this operating piece 86 is confronted to the lower part of the pin 84, at the same time, the pointed end of the vertical side-part of the operating piece 86 is confronted to the front-face of the eye-frame 20. A coil-spring 87 is stretched between the side of this eye-frame 20 and the head-frame 16 so that the eye-frame 20 is always energized forwards and the front of the intermediate part of said eye-frame 20 is touched and contacted to the pointed part of the vertical side-part of the operating piece 86.

Figure 5:
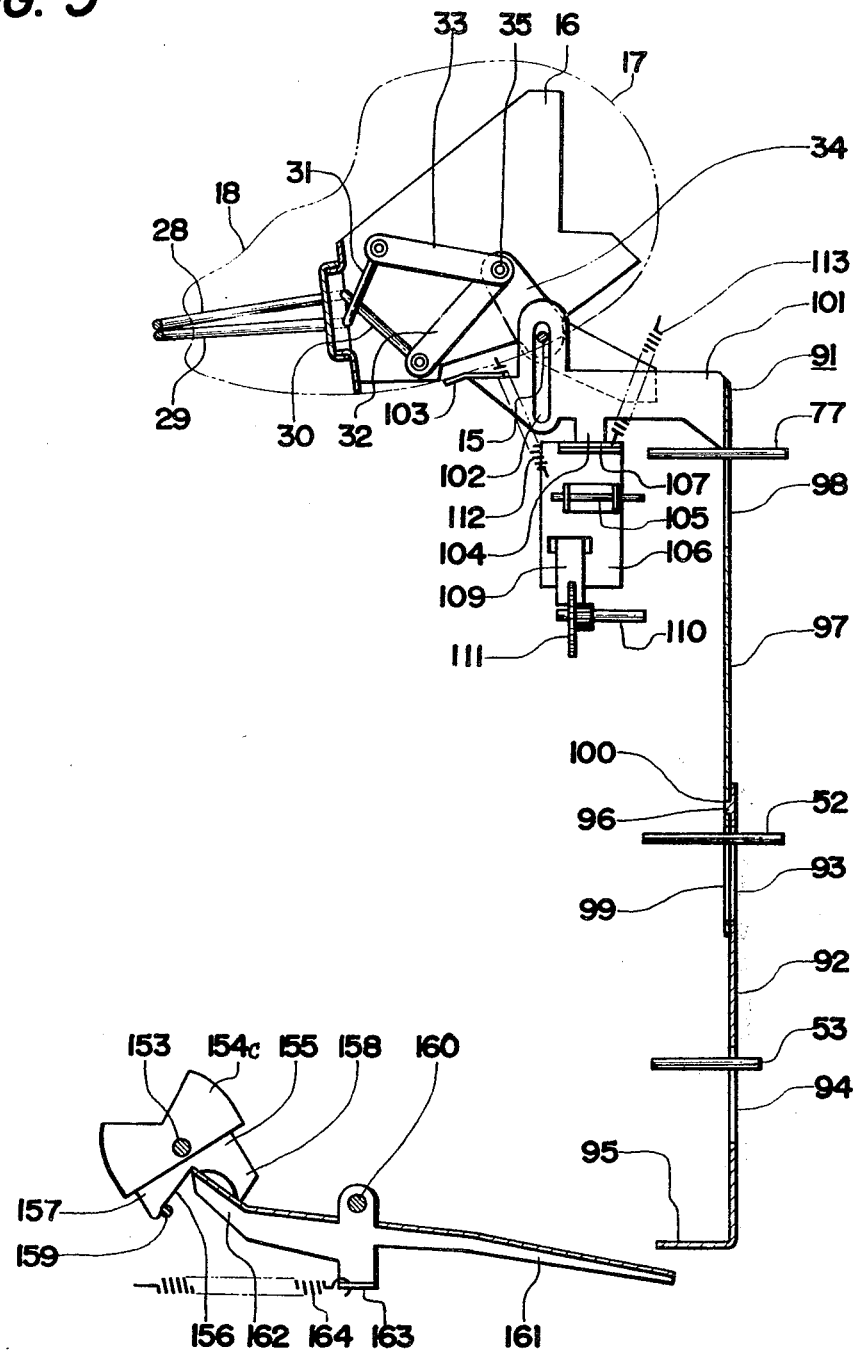
FIG. 5 shows a sectional side view of a third operation means.
Figure 8:
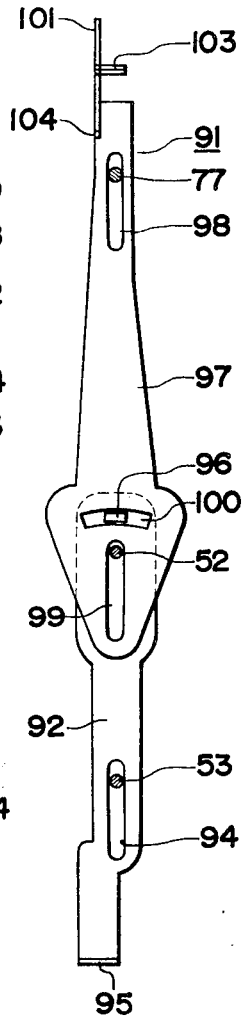
Figure 7:
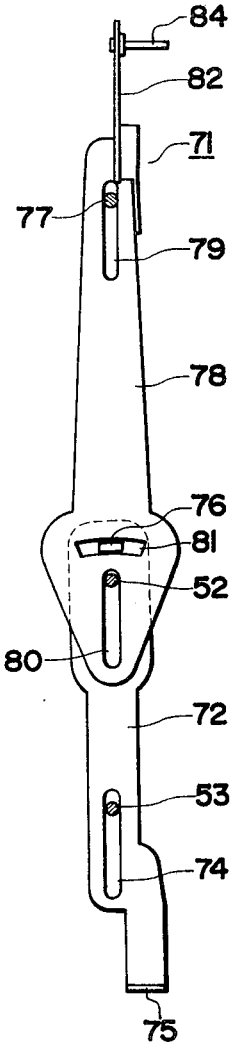

Next, explanation is made on the third operation means 91 which moves the head and mouth of the toy-body 11. This third operation means 91 is demonstrated in FIGS. 1, 2 and 5 as well as FIG. 8. An operating plate 92 is upheld movably freely in the vertical direction by the supporting shafts 52, 53 of the fixed frame 12 through vertically prolonged holes 93, 94 perforated at the upper and lower parts of said plate 92, while a push-moving part 95 is formed by bending forwards at the lower end-part of the operating plate 92, at the same time, a projection 96 is protrudently installed to the front of the upper end-part of the operating plate 92. Also, an upper operating plate 97 is supported movably freely in the vertical direction by the supporting shaft 52 and the supporting shaft 77 of the movable frame 13 at the front position of the plate 92 through vertically prolonged holes 98, 99 perforated vertically at the upper and lower parts of said plate 97. An arched laterally prolonged hole 100 is formed or perforated at the upper operating plate 97, above the shaft 52 and the projection 96 is engaged to this prolonged hole 100. An operating part 101 is formed by bending forwards at the upper end of the operating plate 97. A prolonged hole 102 is formed vertically at this operating part 101, and this prolonged hole 102 is inlaid with the supporting shaft 15 of the head-frame 16. Further, a push-moving piece 103 is formed by bending horizontally at the front end-upper part of the operating part 101 of the operating plate 97, at the same time, a push-moving piece 104 is installed protrudently to the lower site of the operating part 101. Said operating plate 92 and upper operating plate 97 compose an operating body movable as a unit in the vertical direction.

The intermediate part of the lever 106 is supported rotatably freely by a supporting shaft 105 at one side-upper part of the fixed frame 12 and a push-moving part 107 is formed by bending inwards at the upper end-part of this lever 106. This push-moving part 107 is confronted to the lower part of the push-moving piece 104. Moreover, a box type-resonator 108 is installed to the outside of the above lever 106, and the inner end-part of a hanging piece 109 consisting of a spring plate is fixed to the inner face of this resonator 108, while the pointed part of this piece 109 is projected inwards and confrontedly installed around the periphery of a gear 111 mounted on a rotary shaft 110 of a gear-interlocking mechanism as mentioned later.

A coil-spring 112 is stretched between the lower part of the head-frame 16 and the movable frame 13 so that the head-frame 16 is always energized downwards and the lower face of the head 17 is touched and contacted to the push-moving piece 103. Also, a coil-spring 113 is stretched between the lever 106 of the resonator 108 and the movable frame 13, thereby, the lever 106 is always energized upwards and the push-moving part 107 of the lever 106 is touched and contacted to the push-moving piece 104.

Figure 9:
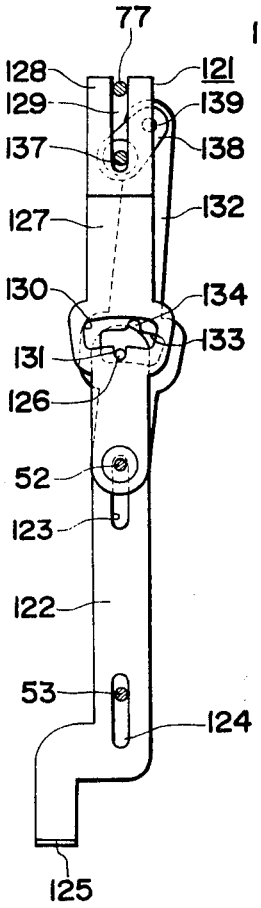
FIGS. 6–9 show front views of the principal parts of each operation means.

Next, explanation is made on the fourth operation means 121 which moves the trunk of toy-body 11. The fourth operation means 121 is shown in FIGS. 1, 2 and 9. An operating plate 122 is supported movably freely in the vertical direction by the supporting shafts 52, 53 of the fixed frame 12 through vertically prolonged holes 123, 124 perforated at the upper and lower parts of the plate 122 and a push-moving part 125 is formed by bending forwards at the lower end of the operating plate 122, at the same time, a hanging pin 126 is installed protrudently to the front of the upper end of the operating plate 122. The lower end-part of an upper operating plate 127 which serves as an engaging member is mounted rotatably freely on the supporting shaft 52 of the movable frame 13 at the front position of the operating plate 122. A vertically prolonged hole 129 is formed or perforated at a part 128 which is formed by bending in the form of nearly L-type at the upper end-part of this upper operating plate 127. The supporting shaft 77 is inlaid in this prolonged hole 129. Also, a window-hole 130 extending laterally is formed or perforated at the intermediate part of the operating plate 127, and a concave part 131 is installed to the central lower part of this window-hole 130. The hanging pin 126 is hung at this hanging concave part 131. Further, the lower end-part of a rotary plate 132 located between the operating plate 122 and the upper operating plate 127 is fixed to the supporting shaft 52 of the fixed frame 12. A window-hole 133 extending laterally is formed or perforated at the intermediate part of the rotary plate 132. A concave part 134 is formed at the central upper part of this window-hole 133.

Also, a motor 135 is installed to the front-lower part of the movable frame 13, at the same time, the gear-interlocked mechanism 136 connected interlockingly to the motor 135 is installed to the upper position of the motor 135 in front of the movable frame 13. The rotary shaft 110 provided with the gear 111 is mounted on the gear-interlocking mechanism 136. A driving shaft 137 is installed to the upper part of the gear-interlocking mechanism 136 and protruded backwards passing through the prolonged hole 129 of the upper operating plate 127. While one end-part of a coupling lever 138 is fixed at the hind end-protruding part of the driving shaft 137, and the other end-part of said coupling lever 138 is connected rotatably freely to a shaft 139 at the upper end-part of the rotary plate 132.

On the other hand, a switch 140 is installed at one side-upper part of the cover 3 of the basic stand 1, at the same time, a battery 141 is connected to the motor 135 through the switch 140 upon the base 2 of the basic stand 1, thereby constituting a driving device 142. Moreover, the operating plates 54, 72, 92 and 122 of the operation means 51, 71, 91 and 121 and the upper operating plates 78, 97 and 127 are arranged independently one another forwards and backwards in the fixed frame 12 and the movable frame 13, as shown in FIG. 2.

An operational device 151 is installed on the basic stand 1. In this operating device 151, a frame 152 is fixed upon the base 2 of the basic stand 1, and a supporting shaft 153 is installed horizontally at the front end-upper part of the frame 152, while four push buttons 154*a*, 154*b*, 154*c* and 154*d* are upheld rotatably freely forwards and backwards at the central part thereof by said shaft 153. Operating pieces 155 are protrudently installed to the central part of the lower faces of these push buttons 154*a*, 154*b*, 154*c* and 154*d*. A concave part 156 is formed at the central part of each operating piece 155 and suspending parts 157, 158 are formed at the front and hind parts thereof. Also, by the frame 152, a stopper lever 159 is supported at the lower part or a little forward position of the supporting shaft 153. Moreover, a supporting shaft 160 is upheld horizontally by the frame 152 at the intermediate part thereof and by this supporting shaft 160, four levers 161 corresponding to each of said push buttons 154*a*, 154*b*, 154*c* and 154*d* are upheld rotatably freely, thus a push-moving part 162 at the front end-part of each lever 161 is confronted to the concave part 156 of each of said push buttons 154*a*, 154*b*, 154*c* and 154*d*. Coil-springs 164 are each stretched between a protruding piece 163 projected at the intermediate lower part of the lever 161 and the front end-part of said frame 152 so that each lever 161 is always energized in such a manner that the front end-part is facing upwards and the rear end-part of each lever 161 is touched and contacted to the respective one of said push-moving parts 57, 75, 95, 125 of said operating plates 54, 72, 92, 122.

Next, explanation is made on the operation of this embodiment of the invention.

In the non-operating state, the push buttons 154*a*, 154*b*, 154*c* and 154*d* of the operating device 151 and those corresponding levers 161 are in the state shown in the drawings and the operating plates 54, 72, 92 and 122 of each operating mechanism 51, 71, 91 and 121 are in the descending state.

In operation, firstly the driving device 142 of the fourth operation means 121 starts its operation. That is, when the switch 140 of the basic stand 1 is set to "ON", the power-source circuit of the battery 141 for the motor 135 is closed, and the motor 135 is driven. By the drive of this motor 135, the driving shaft 137 starts the rotation through the gear-interlocking mechanism 136. With the rotation of this driving shaft 137, the coupling lever 138 fixed to this driving shaft 137 starts the rotation around the driving shaft 137, at the same time, the rotary lever 132 connected to said coupling lever 138 through the shaft 139 starts its reciprocation around the supporting shaft 52.

In this case, the hanging pin 126 protruding to the operating plate 122 of the fourth operation means 121 is being hung to the suspending concave part 131 of the upper operating plate 127, therefore, the upper part-operating plate 127 is in a fixed state with respect to the operating plate 122. Accordingly, when the coupling lever 138 rotates the rotary plate 132 starts the reciprocal movement and the distance between the driving shaft 137 and the supporting shaft 52 changes by the coupling lever 138 and the rotary plate 132. Thus, the driving shaft 137 starts its vertical reciprocation along the prolonged hole 129, because the lateral movement of the driving shaft 137 is restricted by the prolonged hole 129 at the hanging part 128 of the upper operating plate 127. By the vertical movement of this driving shaft 137, the movable frame 13 makes the vertical reciprocation against the fixed frame 12 through the gear-interlocking mechanism 136 supporting this driving shaft 137. Thereby, the trunk 14 moves vertically, and the toy-body 11 moves likewise.

Figure 3:
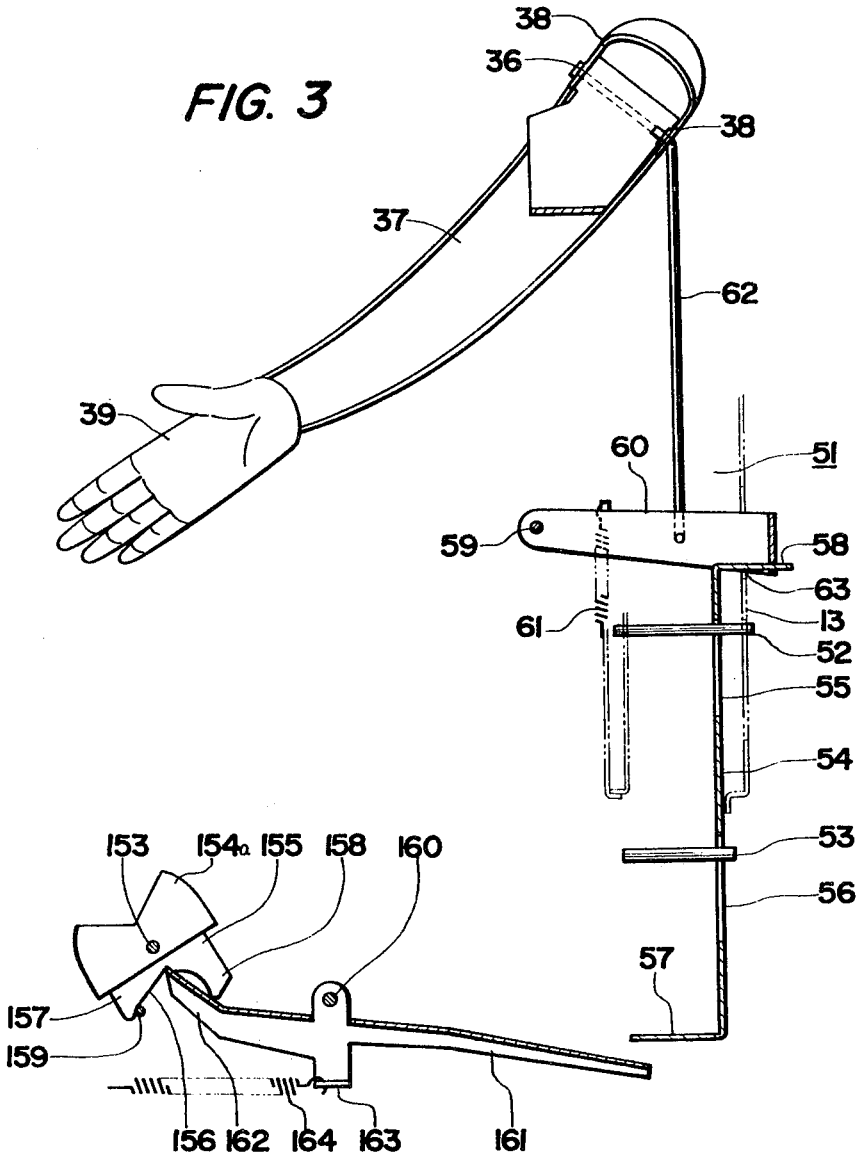
FIG. 3 shows a sectional side view of a first operation means of FIG. 1.
Figure 4:
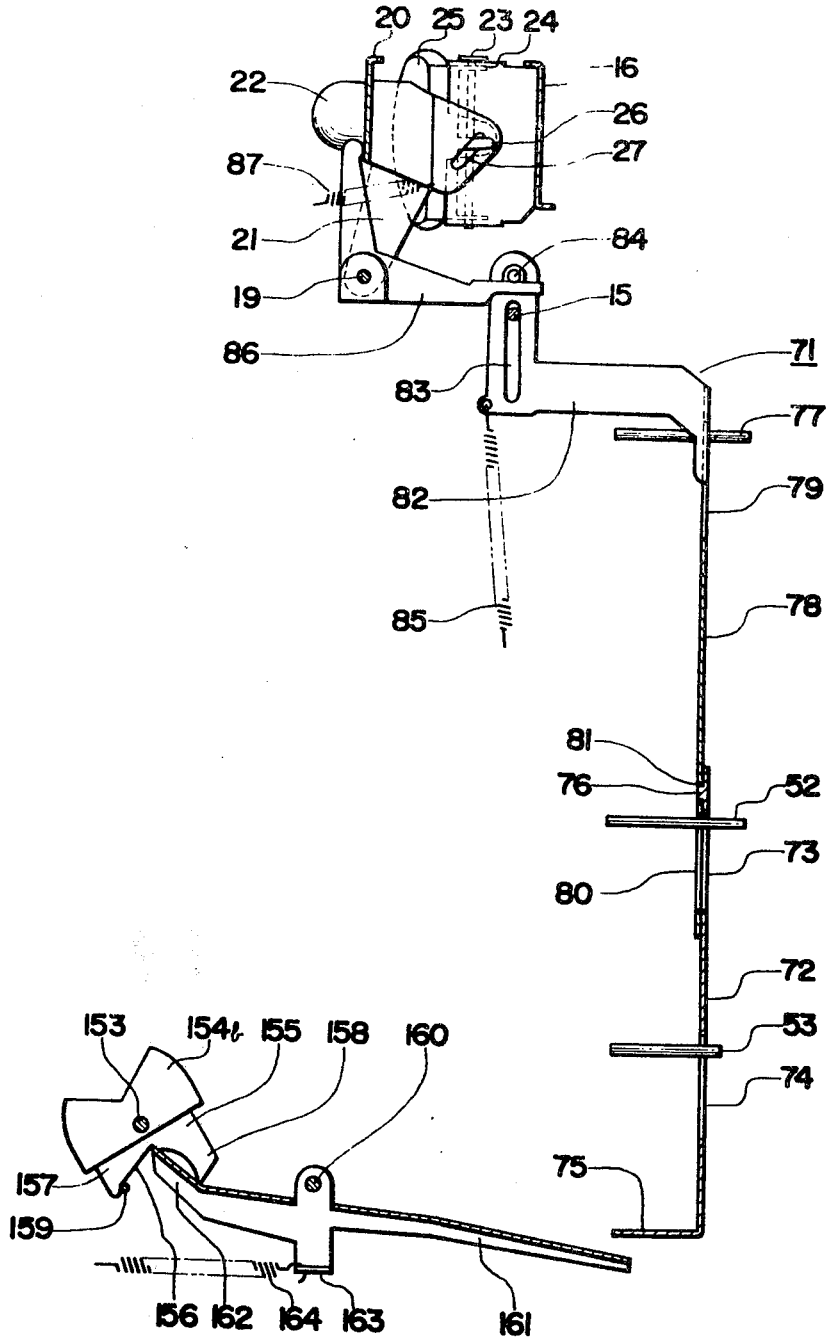
FIG. 4 shows a sectional side view of a second operation means.

Under the state of the vertical movement of this movable frame 13, the operating part 58 of the operating plate 54 of the first operation means 51 is suspended at the lower end of the aperture-part 63 of the movable frame 13, and moved vertically with the movable frame 13. Under this state, when the first push button 154a is operated, the arm 37 is operated by the first operation means 51. That is, as shown in FIG. 3, when the push button 154a is rotated in the clockwise direction around the supporting shaft 153 as a fulcrum by pressing the suspending part 158 of the operating piece 155 of the push button 154*a* presses and lowers the push-moving part 162 of the lever 161, and the lever 161 is rotated in the counterclockwise direction around the supporting shaft 160 as a fulcrum. The hind end-part of the lever 161 pushes upwards the push-moving part 57 of the lower end-part of the operating plate 54 and elevates the operating plate 54 along the supporting shafts 52, 53, as a "guide", engaged with the prolonged holes 55, 56. The elevation of the upper operating plate 54 induces the upward movement of the hind side-part of the operating frame 60 by the operating part 58 of the upper end-part of the operating plate 54 and the operating frame 60 moves upwards around the supporting shaft 59 as a fulcrum.

Under the state that the hind side-part of the operating frame 60 is ketp with the operating plate 54, when the supporting shaft 59 moves vertically with the vertical movement of the movable frame 13, the operating frame 60 starts its vertical reciprocation with respect to the movable frame 13 because the operating frame 60 is energized in the lower direction by the spring 61. This reciprocation of the movable frame 60 induces the vertical movement of the coupling levers 62 at the both sides of the movable frame 60. Thus, the arms 37 connected to the coupling levers 62 of both sides move around the supporting shafts 36 and the both hands 39 contact and detach each other, thereby the toy-body 11 makes the movement such as the hand-clapping.

When the first push button 154*a* is reversed in its previous state, the suspending part 157 is contacted to the stopper lever 159, and the lever 161 returns to the diagrammed state by the action of the spring 164. At the same time, the pushing up power to the operating plate 54 by the lever 161 is released and the operating frame 60 rotates in the clockwise direction in FIG. 2 by the action of the spring 61. Thus the operating plate 54 is pushed downwards, and the operating part 58 is suspended at the lower end of aperture 63 of the movable frame 13, thereby the operating frame 60 is kept at the descent-position and the arm 37 stops its action.

Also, under the state of vertical movement of the movable frame 13, the upper part-operating plate 78 of the second operation means 71 is suspended at the supporting shaft 77 of the movable frame 13 through the prolonged hole 79, and moves vertically with the movable frame 13. In this state, when the second push button 154*b* is operated, the eyes 22 and ears 25 are operated through the second operation means 71. That is, in FIG. 4, when rotated in the counter-clockwise direction by pressing the second push button 154*b*, as with the above mentioned first push button 154*a*, the lever 161 is rotated in the counter-clockwise direction and pushes up the push-moving part 75 of the lower end of the operating plate 72 at the hind end-part of the lever 161, and elevates the operating plate 72 through the prolonged hole 73, 74, as the guide, engaged with the supporting shafts 52, 53. By elevation of this operating plate 72, the upper operating plate 78 is pushed up through the upper end-suspending projection 76 engaged with the prolonged hole 81 and is elevated through the prolonged holes 79, 80, as guide, hung to the supporting shafts 77, 52, thus the pin 84 of the upper operating plate 78 is situated upwards.

Under this state, as mentioned above, the vertical movement of reciprocation of the movable frame 13 induces the rotary movement of the operating piece 86 with the head-frame 16 around the supporting shaft 19 because the operating piece 86 and eye-frame 20 are energized by the spring 87. Therefore, one end-part of the operating piece 86 is in a state of elastic contact to the pin 84 of the operating part 82. When the movable frame 13 moves vertically the operating piece 86 and eye-frame 20 rotate reciprocatingly around the supporting shaft 19, thereby the eyes 22 put out or in, that is, the toy-body 11 makes the protruding or withdrawing movements of the eye-balls.

On the other hand, the reciprocation of the eye-frame 20 induces forward and backward movements of the protruding pieces 26 of the ear-frames 24 and the suspending groove 27. Each ear-frame 24 rotates forwards and backwards around the supporting shaft 23 and the ears 25 move forwards and backwards, thereby the toy-body makes the above mentioned movements of the eyes and the ears.

When the second push button 154*b* is reversed to its previous state the lever 161 rotates and returns to the state shown in the drawings, at the same time, the push-up power of the operating plate 72 by the lever 161 is released and the upper operating plate 78 is lowered by the spring 35, and the pin 84 of the upper operating plate 78 is also lowered. Thus, the horizontal lower side-part of the operating piece 86 is kept at a fixed position and the movements of the eyes 22 and the ears 25 are stopped.

In a state that the movable frame 13 is being moved vertically the upper operating plate 97 of the third operation means 91 is suspended to the supporting shaft 77 of the movable frame 13 through the prolonged hole 98 on the plate 97, moving vertically with the movable frame 13. In this state, the pressing of the third push button 154*c* induces the operation of the head 17 and lips 28, 29. That is, when the third push button 154*c* is rotated in the counter-clockwise direction in FIG. 5, the lever 161 rotates as with the above mentioned first push button 154*a* and the push-moving part 95 at the lower end-part of the operating plate 92 is pushed up with the lever 161, and the operating plate 92 is elevated through the prolonged holes 93, 94 hung to the supporting shafts 52, 53 as guides. The elevation of this operating plate 92 induces the pushing-up of the plate 97 through the projection 96 of the upper end-part of the plate 92 and the long groove 100 on the plate 97, thereby the upper operating plate 97 is elevated through the prolonged holes 98, 99 suspended with the supporting shafts 77, 52. The elevation of this upper operating plate 97 induces the elevation of the push-moving pieces 103, 104 of the operating part 101, and in this case, the head-frame 16 is energized by the spring 112, thus the head-frame 16 is in contacting state with the push-moving piece 103 of the operating part 101. Also, the lever 106 of the resonator 108 is energized by the spring 113, therefore the lever 106 of the resonator 108 is in contact with the push-moving piece 104.

Under this state, when the movable frame 13 starts the vertical movement of reciprocation, the head 17 of the head-frame 16 starts the reciprocation around the supporting shaft 15, thereby the toy-body 11 starts the movement of shaking the head forwards and backwards.

On the other hand, at the same time of the rotation of the head-frame 16, the movable quadrilateral frame consisting of the coupling parts 30, 31 of lips 28, 29 and the links 32, 33 is deformed. The links 32, 33 rotate and the lips also rotate, thereby the toy-body 11 starts the movements of shaking the head and opening or shutting the mouth. Moreover, with the vertical movement of the movable frame 13, the lever 106 of the resonator 108 moves vertically and the push-moving part 107 of the lever 106 also moves vertically against the push-moving part 104 of the operating part 101 of the upper operating plate 97. The lever 106 is energized by the spring 113, therefore, the lever 106 rotates reciprocally around the supporting shaft 105 and the pointed part of the piece 109 of the resonator 108 is interlocked with or released from the gear-face of the gear 111 of the rotary shaft 110 of the gear-interlocking mechanism 136. At the same time, the piece 109 vibrates and its vibration is conveyed to the resonator 108, making sound, thereby the toy-body 11 starts it movements of shaking the head and opening or shutting the mouth with sounding.

Moreover, when the third push button 154*c* is reversed to its previous state, as mentioned above, the lever 161 rotates and returns to the state shown in the drawings, at the same time, with the release of the pushing up-power of the operating plate 92 by the lever 161, the upper operating plate 97 is pulled downwards by the spring 112 with the operating plate 92 and the push-moving pieces 103, 104 of the upper operating plate 97 descend. The head 17 is kept at a certain fixed position and the push-moving part 107 of the lever 106 of the resonator 108 is pressed downwards by the push-moving piece 104. Thus, as shown in FIG. 1, the plate 109 is kept at the state detached from the gear 111 and the actions of the head 17 and lips 28, 29 are suspended, while the sounding is also stopped.

Under the state of vertical movement of the movable frame 13, when the fourth push button 154*d* is operated the trunk 14 is operated sideway through the fourth operation means 121. That is, in making rotation by pushing the fourth push button 154*d*, as with the above mentioned first push button 154*a*, the push-moving part 125 of the operating plate 122 is pushed upwards with the rotation of the lever 161 and the operating plate 122 is raised along the supporting shafts 52, 53 engaged with the prolonged holes 123, 124. By the elevation of the operating plate 122, the pin 126 of the upper end-part of the plate 122 is detached from the concave part 131 of the upper operating plate 127 and the pin 126 is suspended to the upper concave part 134 through the hole 133 of the rotary plate 132 and the hole 130 of the upper operating plate 127. Thus, the operating plate 122 and the rotary plate 132 are suspendingly fixed through the pin 126, at the same time, the upper operating plate 122 is in the rotatable state. When the coupling lever 138 is rotated by the driving shaft 137, the side of the driving shaft 137 vibrates laterally around the rotary plate 132 and the trunk 14 swings laterally with the movable frame 13, thereby the toy-body 11 starts the dancing movement.

When the fourth push button 154*d* is reversed, as mentioned above, the lever 161 rotates and returns to the state shown in the drawings. At the same time, the pushing down-power of the operating plate 122 is released by the lever 161, the rotary plate 122 descends, and the pin 126 is detached from the concave part 134 of the rotary plate 132, at the same time, the pin 126 is engaged to the concave part 131 of the upper operating plate 127 and the swinging action of the trunk 14 is suspended.

Thus, by setting the switch 140 "ON", the movable frame 13 starts the vertical movement against the fixed frame 12 and the toy-animal or doll shows te moving action. When the first push button 154*a* is operated, the hand-clapping starts, the operation of the second push button 154*b* induces the protruding of the eyes and forward or backward movement of the ears and the operation of the third push button 154*c* induces forward or backward movement of the head and the movement of the mouth, while making sound. The operation of the fourth push button 154*d* induces the dancing movement of the trunk.

Moreover, by selecting the operation of the first – fourth push buttons 154*a*, 154*b*, 154*c* and 154*d*, any movement is obtained. All the operations of the first to fourth push buttons 154*a*, 154*b*, 154*c* and 154*d* induce all the movements at the same time. Moreover, each movement can be freely combined according to this invention.

The toy-body 11 of the toy-animal or doll shows the action-state by the vertical movement of the movable frame against the fixed frame, and the rotation of the arm, clapping the hands putting-out and in of the eyes or shaking the head is induced with each operation means interlocked to the vertical movements of the movable frame. These movements can be selectively obtained by these means, while each movement can be done at the same time, moreover, each movement can be freely combined, thereby, one can enjoy various movements.

What is claimed is:

1. A motion-toy comprising a fixed frame, a movable frame having a trunk and mounted movably freely with respect to said fixed frame, a head-frame having a head and mounted rotatably freely on said movable frame, an eye-frame having eyes and mounted rotatably freely on said head-frame, arms mounted rotatably freely at both sides of said movable frame, a driving device for moving up and down said movable frame, operation means for operating with said driving device to operate said trunk, head, eyes and arms respectively in association with said up and down movements of said movable frame, and respective operating devices for operating selectively each of said operation means, said operation means comprising an operating plate supported movably freely up and down by said fixed frame and having an operating part engaging with an engaging portion provided on said movable frame in a down position, an operating framework mounted rotatably freely on said movable frame and energized downwards so as to contact with said operating part of the operating plate, interlocking levers connected rotatably freely between the base portions of said arms and said operating framework, and said operating devices including an individual operating device for moving up and down said operating plate.

2. A motion-toy as claimed in claim 1 in which said head-frame is mounted on the upper portion of said movable frame, and said eye-frame is mounted at the forward portion of said head-frame so as to be moved forwards, and in which said operation means comprises an operating part having at its upper portion an engaging member and supported movably freely in the vertical direction by said fixed frame so as to be moved with said movable frame in a down position, and an operating piece mounted rotatably freely at the middle portion thereof on said head-frame, one end portion thereof being engaged with said engaging member of the operating part and the other end portion thereof being contacted with the front face of said eye-frame.

3. A motion-toy as claimed in claim 2 in which said operation means comprises ear-frames each having an ear and mounted rotatably freely on each side of said head-frame, and protruding pieces provided on the both ear-frames so as to be projected through prolonged holes provided at the both sides of said eye-frame.

* * * * *